US006942356B1

(12) United States Patent
Hahn

(10) Patent No.: US 6,942,356 B1
(45) Date of Patent: Sep. 13, 2005

(54) LIGHTING DEVICE FOR A DISPLAY CASE

(75) Inventor: Till Heinrich Hahn, Frankfurt am Main (DE)

(73) Assignee: Glasbau Hahn GmbH & Co. KG, Frankfurt am Main (DE)

( * ) Notice: Subject to any disclaimer, the term of this patent is extended or adjusted under 35 U.S.C. 154(b) by 48 days.

(21) Appl. No.: 10/276,137

(22) PCT Filed: May 8, 2001

(86) PCT No.: PCT/EP01/05177

§ 371 (c)(1),
(2), (4) Date: Nov. 12, 2002

(87) PCT Pub. No.: WO01/84985

PCT Pub. Date: Nov. 15, 2001

(30) Foreign Application Priority Data

May 11, 2000 (DE) ..... 200 08 446 U

(51) Int. Cl.[7] ..... A47F 11/10
(52) U.S. Cl. ..... 362/125; 362/154; 362/240; 362/249
(58) Field of Search ..... 362/240, 241, 362/244, 249, 125, 154, 156

(56) References Cited

U.S. PATENT DOCUMENTS 5,012,160 A * 4/1991 Dunn Thompson ..... 313/149
5,437,504 A 8/1995 Halvatzis
6,676,284 B1 * 1/2004 Wynne Willson ..... 362/555

FOREIGN PATENT DOCUMENTS

DE 3918193 A1 12/1990

* cited by examiner

*Primary Examiner*—John Anthony Ward
(74) *Attorney, Agent, or Firm*—Bucknam and Archer

(57) ABSTRACT

A rod-shaped light fitting (8) for a showcase, whose length corresponds to the distance between two opposite side surfaces (4, 6) of the showcase which are plane-parallel to one another, comprises a plurality of light-emitting diodes (12) and can be positioned between the said side surfaces (4, 6) in such manner that the contacts (16) fixed in each end (9) of the rod-shaped light fitting (8) and electrically connected to the light-emitting diodes (12) press against the side surfaces (4, 6) under spring loading and at the same time establish electrical connection with the electrically conductive layer provided on the side of the side surfaces (4, 6) facing the inside of the showcase, the said layers being connected to a current source. Such a light fitting can be positioned in any desired position in a showcase to illuminate the objects displayed therein.

10 Claims, 2 Drawing Sheets

LIGHTING DEVICE FOR A DISPLAY CASE

CROSS REFERENCE TO RELATED APPLICATIONS

Figure 1:
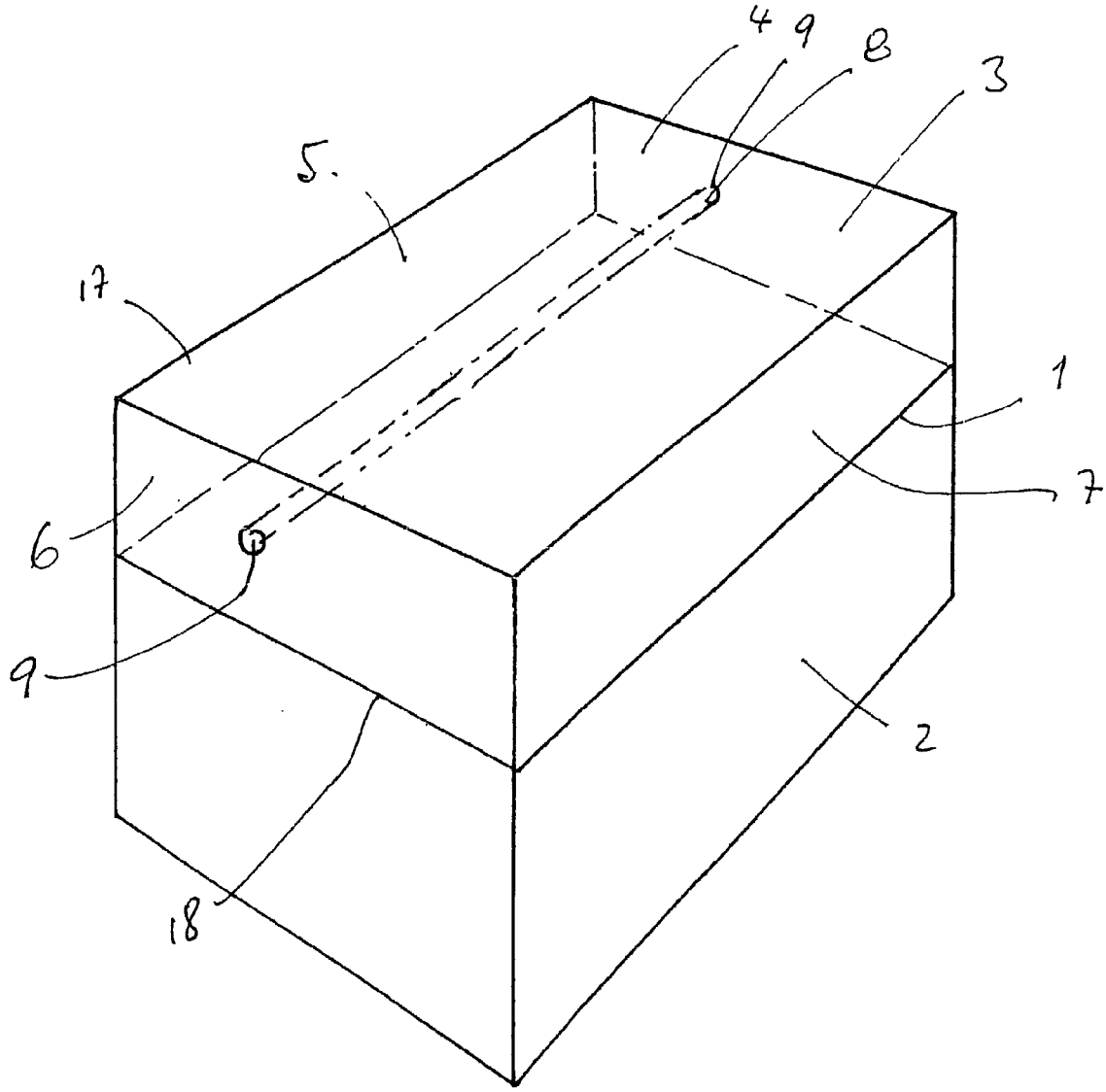

Applicant claims priority under 35 U.S.C. §119 of German Application No. 200 08 446.1 filed on May 11, 2000. Applicant also claims priority under 35 U.S.C. §365 of PCT/EP01/05177 filed on May 8, 2001. The international application under PCT article 21(2) was not published in English.

The invention concerns a light fitting for a showcase for the display of objects, in which the space accommodating the objects is enclosed by several side surfaces at least two of which are opposite and plane-parallel to one another.

Such a light fitting is already known. Thus, in European Patent 0 670 129 a showcase with a light fitting is described, in which light fibres for the illumination of the objects on the tray below end on the underside of each individual tray, and the said fibres are bundled and pass through a common duct. A drawback with this type of lighting is the need to have a tray to hold the light fibres. The same applies also in the case when the light fibres end in the ceiling of the showcase. In both cases the type of lighting is determined by the predetermined arrangement of the outlet openings on the underside of the tray or the ceiling, which does not allow any choice of the illumination of particular areas or objects in the showcase. However, this can be done by replacing the tray or the surface forming the ceiling by one in which the outlet openings for the light fibres are appropriately arranged.

The purpose of the present invention is to provide a light fitting for a showcase, which allows flexible illumination of the objects in the showcase in a simple way.

This objective is achieved in that the light fitting comprises a plurality of light-emitting diodes and is formed as a rod of length corresponding to the distance between two opposite side surfaces which can be fixed between these side surfaces by suitable means attached to the light fitting, the current being supplied to the light fitting via the side surface(s).

The rod-shaped light fitting can be positioned in any position between the two side faces and can also be removed, so the objects can be illuminated just as desired.

From German utility model G 87 07 283.1 a low-voltage light for shelf partitions is already known, with vertical supports arranged on each side of a partition and electrical conductors embedded in the supports, a rod-shaped light carrier track being provided that can be connected at each end to a conductor to form electrical contact, such that the current lines are connected to at least one bulb on the light carrier track. In this, the light carrier track can only be attached in the area of the supports.

A similar lighting arrangement for an item of furniture having vertical wall sections parallel to one another is known from DE 39 18 193 A1. In this case current is supplied to a lighting element, which for example is incorporated in a cross-member connecting the two wall sections in the form of an insertion plate, via electrical voltage connections distributed over the height of the wall section which allow connection to a light element at the respective height chosen. In this lighting arrangement too, attachment is only possible in the area of the voltage connections.

In addition, in utility model DE 297 17 444 U1 an infra-red-free and ultraviolet-free light for goods cooled in a refrigerator is described, in which several rectangular plates having numerous light-emitting diodes on their underside are attached one after another to rails parallel to the longitudinal dimension of the inside, the said rails being mounted on a projection of the refrigerator extending inwards over the inside space. Nothing further is said about how current is supplied to the plates carrying the light diodes.

Other advantages emerge from the subordinate claims.

The present innovation is described in more detail below with reference to an example embodiment illustrated in the drawing, which shows:

FIG. 1: Perspective view of a showcase

Figure 2:
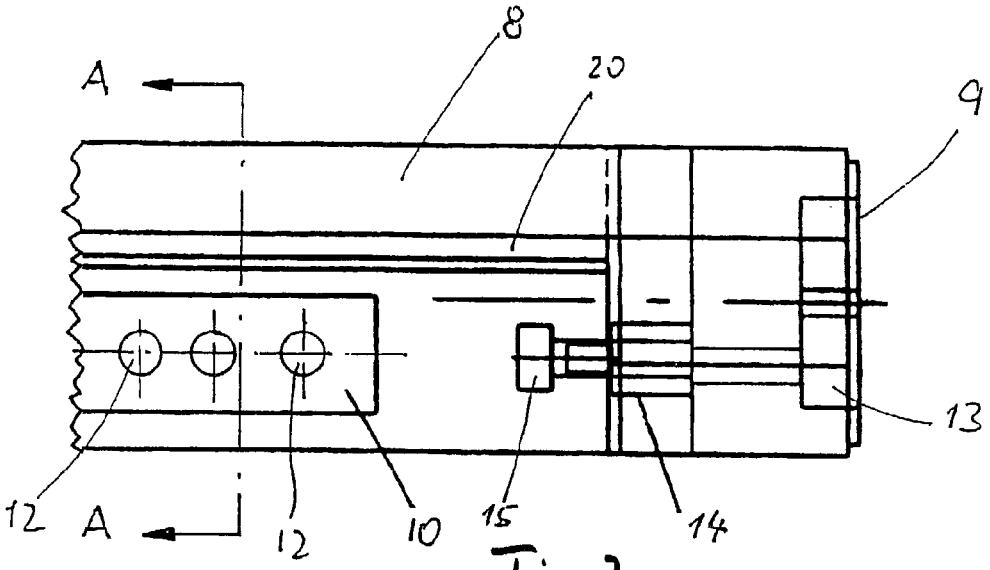

FIG. 2: Side view of the light fitting

Figure 3:
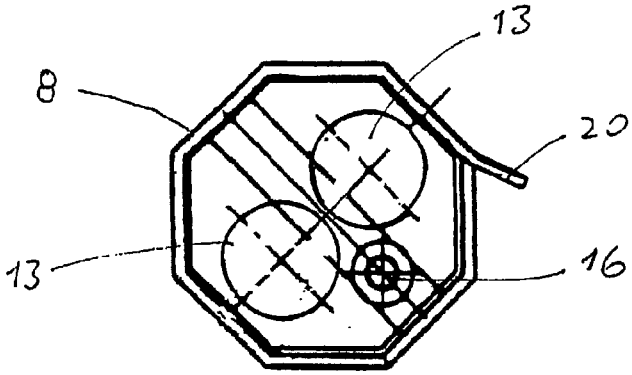

FIG. 3: Plan view of one end of the light fitting

Figure 4:
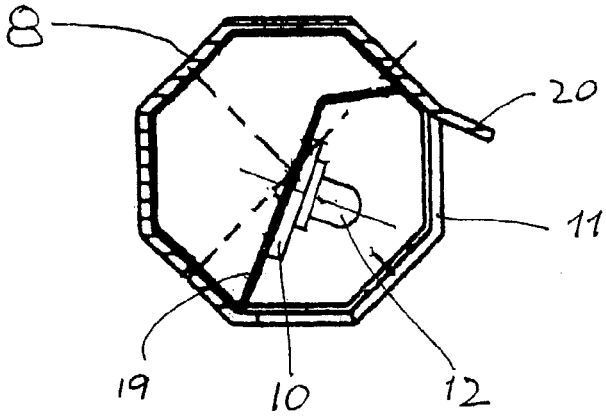

FIG. 4: Section A—A through the light fitting.

The showcase shown in FIG. 1 consists of a lower portion 2 and an upper portion 3, the said upper portion 3 formed of a left-hand side surface 4, a front surface 5, a right-hand side surface 6 and a back surface 7. A surface 17 closing the top, together with the surfaces 4 to 7, forms the space in which the objects to be displayed are placed, these resting on a bottom surface 18 that closes the said space at the bottom. At least the front surface 5 and the closing surface 17 at the top are as a rule made of panes of clear glass, and this can also be true of the other side surfaces. The prerequisite for the use of the innovation, however, is that two opposite surfaces, for example the left-hand side surface 4 and the right-hand side surface 6, must be plane-parallel to one another. The upper portion 3 can either be large, such that it reaches nearly to the floor, when the lower portion 2 of a free-standing showcase is made correspondingly low, or it may be at table height when the lower portion 2 is made correspondingly high and the upper portion of such a table-top showcase only has a small height. Whereas with a table-top showcase the objects only rest on the bottom surface 18, with a free-standing showcase the objects can also be placed at one or more intermediate levels positioned one above the other. The use of the innovation is not restricted to the table-top showcase illustrated in FIG. 1, but can also be used with free-standing showcases. The light fitting 8 is positioned between two plane-parallel side surfaces (for example 4 and 6), its length between the two ends 9 corresponding to the inside distance between the two side surfaces.

The light fitting 8 has a plurality of light-emitting diodes 12 (FIGS. 2 to 4), preferably ones that emit white light, which are distributed along the entire length of the light fitting 8. It is also conceivable, however, to arrange the light-emitting diodes 12 in preferred areas or, by incorporating corresponding switching means, to operate them in sections that can be switched on or off. The current is supplied to the light-emitting diodes 12 via the side surfaces between which the light fitting 8 is positioned. For this purpose the side surfaces (for example 4 and 6) which the light fitting 8 touches can either be made completely of an electrically conducting material, or they can be of an insulating material coated with an electrically conducting layer on the side facing the inside space of the showcase. This can even be a pane of glass provided by vaporisation with a very thin electrically conductive layer which is completely or almost completely invisible to the human eye. Electrical connection between the light fitting 8 and the side surfaces (for example 4 and 6) is established by means of one or more ball-type or spherical contacts 16 mounted under spring loading at one or both ends 9 of the light fitting 8 which, when the light fitting 8 has been fitted into the inside space of the showcase, press against the inside of the side surface concerned. Current can now be supplied via one or both ends 9 of the light fitting 8. If the contacts 16 are present at both ends 9 of the light fitting 8, then one pole of the current source (not shown) is connected to one side surface and the other pole of the current source to the opposite side surface. It is also conceivable, however, to pass the current lead for the light-emitting diodes 12 only through one end 9 of the light fitting, and in this case both poles of the current source are correspondingly connected to one side surface and, at the side surface in question, the two poles are connected to strip-shaped surfaces next to or under one another and the contacts 16 on the end in question are arranged in a corresponding way. It is also possible to provide the side of one or more side surfaces (4 and/or 6) facing the inside space of the showcase with a coating of lacquer and in this case the contacts 16 are made needle or cone shaped so that they penetrate through the lacquer layer to make contact.

The light fitting 8 can be held in the desired position between the two side surfaces (for example 4 and 6) by the contact pressure of the contacts themselves 16 against the inside of the side surfaces. It is also conceivable, however, if the two side surfaces are made from a magnetic material such as sheet steel, to provide axially displaceable magnets 13 at one or both ends 9 of the light fitting 8, each held in its rest position by a spring 14. As soon as the light fitting 8 is in the desired position between the two side surfaces, it can be fixed there by the axially displaceable magnets 13. To release the connection between the light fitting and the side surfaces, the respective magnet 13 can be detached from the side surface by pulling on the handle 15. A similar solution is also possible for the contacts 16, in which case these too are arranged so that they can move in the axial direction relative to the light fitting 8 and/or are spring loaded, and when the light fitting is in its desired position they are brought into contact with the side surfaces (4, 6) and are released therefrom before the light fitting is removed. This can also be done by means of a handle similar to the handle 15. Depending on the weight of the light fitting 8, the spring pressure of the contacts 16 may already be sufficient to hold the light fitting securely between the two side surfaces (for example 4 and 6).

The rod-shaped housing of the light fitting 8 can for example have a circular, oval or polygonal cross-section (FIGS. 3 and 4) and can either be bent to the corresponding shape from sheet steel or consist of an extrusion. In the area of the light-emitting diodes 12 a mounting surface 19 is provided close to a through-going opening 11, such that on the mounting surface 19 a substrate 10 in the form of a printed circuit board carrying the conducting paths and the light-emitting diodes 12 connected thereto is attached. As shown in FIG. 2, the opening 11 can extend almost as far as each end 9, and the housing is then only closed in the area of the springs 14 and magnets 13, while the handle 15 is already in the opening 11. The opening 11 is provided at the top with a screen 20 and, when positioned in the showcase, is correspondingly turned to face the area to be illuminated in the showcase. If needs be, the screen 20 can also be attached to the underside of the opening 11.

What is claimed is:

1. Light fitting for a showcase for the display of objects, in which the space containing the objects is enclosed by several side surfaces, at least two of the said side surfaces being arranged opposite and plane-parallel to one another, wherein the light fitting (8) comprises a plurality of light-emitting diodes (12) and is rod-shaped having two opposing ends (9) and a length corresponding to the distance between said at lest two opposite and plane-parallel side surfaces (4 and 6) of said showcase, said light fitting (8) including means for removably fixing said light fitting between said at least two opposite and plane-parallel side surfaces (4 and 6) and further including electrical contacts (16) arranged on at least one of the opposing ends of said rod-shaped light fitting (8) in contact with at least one of said at least two opposite and plane-parallel side surfaces (4 and 6), wherein said at least two opposite and plane-parallel side surfaces (4 and 6) of said showcase are electrically conductive so that electric current may be supplied to said light fitting (8) via said electrical contacts (16) wherever said light fitting (8) is fixed between said at least two opposite and plane-parallel side surfaces (4 and 6).

2. Light fitting according to claim 1, wherein said at least two opposite and plane-parallel side surfaces (4 and 6) are made of an electrically conducting material.

3. Light fitting according to claim 2, wherein said at least two opposite and plane-parallel side surfaces (4 and 6) consist of sheet steel and at the two ends (9) of the light fitting (8) magnets (13) are attached, which are so formed and mounted that a detachable connection can be formed between an end (9) of the light fitting (8) and the corresponding side surface (4, 6).

4. Light fitting according to claim 3, wherein the magnet (13) is mounted axially and held in its rest position in each case by a spring (14).

5. Light fitting according to claim 4, wherein the magnet (13) can be detached from the side surface by means of a handle (15).

6. Light fitting according to claim 1, wherein one or both of said at least two opposite and plane-parallel side surfaces (4, 6) consists of a glass plate provided with an electrically conductive layer on the side facing the inside space.

7. Light fitting according to claim 6, wherein the said electrically conductive layer is transparent.

8. Light fitting according to claim 1, wherein spring-loaded contacts (16) are mounted at one or both ends (9) of the light fitting (8).

9. Light fitting according to claim 8, wherein the contacts (16) are formed in the shape of balls, spheres, needles or cones.

10. Light fitting according to claim 8, wherein the contacts (16) are mounted axially and are held in the rest position by means of a spring (14), such that they can be detached from said at least two opposite and plane-parallel side surface (4, 6) by means of a handle.

* * * * *